US008371420B2

(12) United States Patent
Kondo et al.

(10) Patent No.: US 8,371,420 B2
(45) Date of Patent: Feb. 12, 2013

(54) ELEVATOR SYSTEM FOR REDUCING COLLISION SHOCK

(75) Inventors: Rikio Kondo, Tokyo (JP); Hiroshi Kigawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 294 days.

(21) Appl. No.: 12/740,371

(22) PCT Filed: Dec. 17, 2007

(86) PCT No.: PCT/JP2007/074209

§ 371 (c)(1),
(2), (4) Date: Apr. 29, 2010

(87) PCT Pub. No.: WO2009/078088

PCT Pub. Date: Jun. 25, 2009

(65) Prior Publication Data

US 2010/0258382 A1 Oct. 14, 2010

(51) Int. Cl.
*B66B 1/32* (2006.01)

(52) U.S. Cl. ..... 187/288; 187/393

(58) Field of Classification Search ..... 187/247, 187/249, 277, 287, 288, 391–393
See application file for complete search history.

(56) References Cited

U.S. PATENT DOCUMENTS 3,779,346 A * 12/1973 Winkler ..... 187/294
4,133,413 A * 1/1979 Watanabe ..... 187/289
4,318,456 A * 3/1982 Lowry ..... 187/294
4,434,874 A * 3/1984 Caputo ..... 187/293
5,637,841 A * 6/1997 Dugan et al. ..... 187/294
5,663,538 A * 9/1997 Sakita ..... 187/382
5,877,462 A * 3/1999 Chenais ..... 187/249
6,032,761 A * 3/2000 Coste et al. ..... 187/294
6,082,498 A * 7/2000 Coste et al. ..... 187/291
7,533,763 B2 * 5/2009 Kattainen et al. ..... 187/394
7,686,139 B2 3/2010 Kondo et al.
7,849,975 B2 * 12/2010 Ketonen et al. ..... 187/394
7,931,128 B2 * 4/2011 Sakai et al. ..... 187/293

(Continued)

FOREIGN PATENT DOCUMENTS

JP 7 157211 6/1995
JP 7 206288 8/1995

(Continued)

OTHER PUBLICATIONS

U.S. Appl. No. 12/810,313, filed Jun. 24, 2010, Kondo, et al.

(Continued)

*Primary Examiner* — Anthony Salata
(74) *Attorney, Agent, or Firm* — Oblon, Spivak, McClelland, Maier & Neustadt, L.L.P.

(57) ABSTRACT

An elevator system includes a car (1) traveling up and down along a hoistway; a buffer (15) for stopping the car (1) at an end of the hoistway, brakes (7), (8), and (9) for braking travel of the car (1); a car traveling-information acquisition part for acquiring car traveling information; and a brake controller (10) for controlling the brakes (8) and (9), based upon the information acquired by the car traveling-information acquisition part, so as to reduce a collision speed at a collision of the car with the buffer to below a predetermined speed so that a shock at the collision of the car (1) with the buffer (15) can be absorbed to a level below a specified value.

5 Claims, 6 Drawing Sheets

U.S. PATENT DOCUMENTS

| | | | | |
|---|---|---|---|---|
| 7,980,363 | B2 * | 7/2011 | Kattainen et al. | 187/391 |
| 2009/0229924 | A1 | 9/2009 | Kondo et al. | |
| 2009/0255764 | A1 | 10/2009 | Ueda et al. | |
| 2010/0101896 | A1 | 4/2010 | Ueda et al. | |
| 2011/0011681 | A1 * | 1/2011 | Kondo et al. | 187/247 |

FOREIGN PATENT DOCUMENTS

| | | |
|---|---|---|
| JP | 8-198542 | 8/1996 |
| JP | 8 259140 | 10/1996 |
| JP | 2005-306517 | 11/2005 |
| JP | 2006 306517 | 11/2006 |
| JP | 2007-84239 | 4/2007 |

OTHER PUBLICATIONS

Office Action issued Oct. 31, 2011, in Korea Patent Application No. 10-2010-7009607 (with English translation).

U.S. Appl. No. 13/376,643, filed Dec. 7, 2011, Kondo, et al.

Office Action mailed Nov. 6, 2012 for Japanese Patent Application No. 2009-546102 with English translation.

* cited by examiner

ELEVATOR SYSTEM FOR REDUCING COLLISION SHOCK

FIELD OF THE INVENTION

The present invention relates to an elevator system that is equipped with a brake system for braking its car in emergency.

BACKGROUND ART

A conventional brake system for braking an elevator car has been disclosed in JP H07-206288A. The elevator system described therein can prevent the car from colliding with a hoistway end by rapidly decelerating the car when approaching near a terminal floor.

Patent Document 1: JP H07-206288A

DISCLOSURE OF THE INVENTION

Problem that the Invention is to Solve

Although the elevator system is able to prevent the car from colliding with the hoistway ends and ensures passengers' safety as long as a shock at a collision of the car with the buffer is within a specified value, the deceleration of the car may sometimes become larger than it needs to be, which has brought about a problem of causing passengers in the car to feel uncomfortable.

The present invention is aimed at providing a brake system in which a shock at a collision of the car with a buffer installed on the elevator shaft end is absorbed to a level below a specified value.

Means for Solving the Problem

An elevator system according to the present invention includes a car traveling up and down along a hoistway; a buffer for stopping the car at an end of the hoistway; a brake for braking travel of the car; a car traveling-information acquisition means for acquiring car traveling information; and a brake control means for controlling the brake, based upon the information acquired by the car traveling-information acquisition means, so as to reduce a collision speed at the collision of the car with the buffer to below a predetermined speed so that a shock at the collision of the car with the buffer can be absorbed to a level below a specified value.

Effect of the Invention

According to the present invention, an elevator system includes a car traveling up and down along a hoistway; a buffer for stopping the car at an end of the hoistway; a brake for braking travel of the car; a car traveling-information acquisition means for acquiring car traveling information; and a brake control means for controlling the brake, based upon the information acquired by the car traveling-information acquisition means, so as to reduce a collision speed at a collision of the car with the buffer to below a predetermined speed so that a shock at the collision of the car with the buffer can be absorbed to a level below a specified value. Therefore, slow stopping of the car can be realized.

NUMERAL REFERENCE

1: car, 2: counterweight, 3: hoist rope, 4: sheave, 5: elevator control unit, 6: hoist motor, 7: brake pulley, 8: brake lining, 9: brake lining, 11: hoist-motor encoder, 12: brake coil, 13: brake coil, 14: governor, 15: buffers, 16: brake control unit, 18: safety state determination part, 18*a*: deceleration calculating part, 18*b*: determination part, 18*c*: storage unit, 19: control voltage calculating part, 20: relay, 21: relay, 118: safety state determination part, 118*a*: speed and remaining distance calculating part, 118*b*: determination part, 119: control voltage calculating part, 22: weighing device

BEST MODE FOR CARRYING OUT THE INVENTION

Embodiment 1

Figure 1:
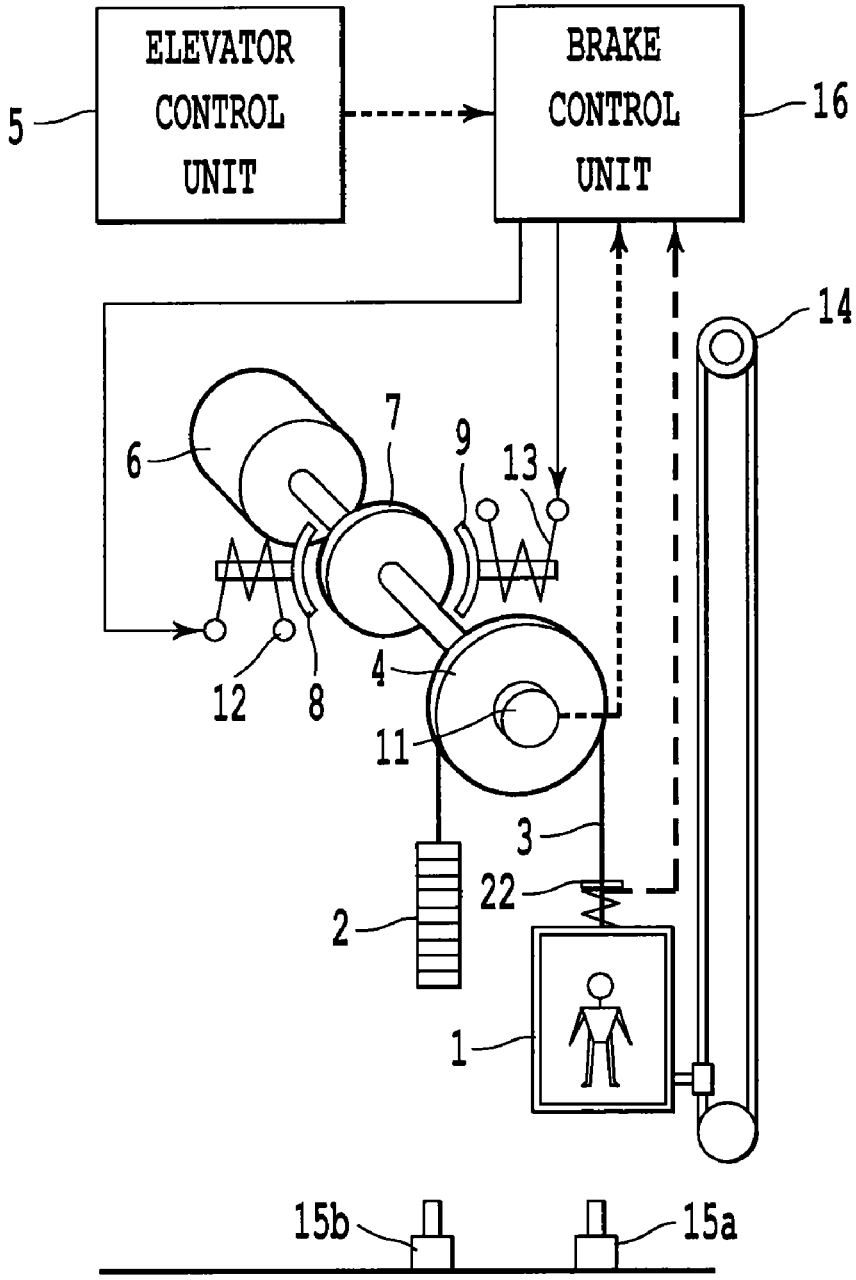
FIG. 1 illustrates a configuration of an elevator system of Embodiment 1.

An overall configuration of an elevator system in this embodiment will be described with reference to FIG. 1. A car 1 and its counterweight 2 that ascend and descend along the hoistway are connected with each other by a hoist rope 3 entrained around a traction sheave 4 that is rotatably driven by a hoist motor 6. In normal operation, the hoist motor 6 drives the sheave 4 according to an instruction from an elevator control unit 5 and drives the hoist rope 3 by friction generated between the sheave 4 and the hoist rope 3 to travel the car 1 and the counterweight 2 connected by the hoist rope 3.

In the brake system, a brake pulley 7 that is fixed to the sheave 4 and rotated is pressed by brake linings 8 and 9 by biasing of elastic members of brake springs. Friction force is thereby generated between the brake pulley 7 and the brake linings 8 and 9, so that the brake linings 8 and 9 brake the brake pulley 7. With this braking action, the hoist motor 6 and the sheave 4 are also braked; and hence, the car 1 and the counterweight 2 are braked.

During normal traveling, the brake linings 8 and 9 are spaced away from the brake pulley 7 by electromagnetic force, so as to exert no braking force on the brake pulley 7.

On the other hand, in a case of the elevator coming into an emergency stop mode, a brake control unit 16 receives (i) an instruction to brake the brake pulley 7 to stop the car 1, from the elevator control unit 5 that governs operation of the elevator because the elevator is in a state that requires a halt of its operation, and (ii) car traveling information from a car traveling-information acquisition means such as a hoist-motor encoder 11, a governor 14, or a position sensor. The brake control unit then calculates deceleration of the car 1 to adjust the pressing force of the brake linings 8 and 9 exerted on the brake pulley 7 by applying a voltage to brake coils 12 and 13 so as to keep up the deceleration with a target deceleration (described later in detail). Thereby, the deceleration of the car 1 is controlled to keep up with the target deceleration. While here described is a case where the brake control unit 16 directly stops the car 1 slowly, the present invention is not limited to this case but includes a case where slow stopping of the car 1 is made indirectly by slowly stopping the counterweight 2. In this case, the deceleration of the counterweight 2 is calculated based on information from the car traveling-information acquisition means or a counterweight traveling-information acquisition means in place thereof, to keep up with the target deceleration.

On the bottom of the elevator shaft, a car buffer 15*a* is provided for downward traveling of the car 1 (a counterweight buffer 15*b* for upward traveling). Even if the car 1 cannot be stopped after passing either terminal floor, the car 1 can avoid colliding with the hoistway ends because the car comes into contact with the car buffer 15*a* (or the counterweight buffer 15*b* in a case of upward traveling) and a shock that would be generated at the collision is thereby absorbed. While the description will be made below for a case where the car 1 travels downwardly and then stops by colliding with the car buffer 15*a*, the present invention is not limited to this case. The invention also includes a case where the car 1 travels upwardly and then stops by collision of the counterweight 2 with the counterweight buffer 15*b*.

The buffers 15 here are devices that serve to stop the car 1, when the car 1 rushes through either terminal floor, without posing a severe shock by being brought into contact with the car 1 before reaching a hoistway end. However, if the car 1 collides with the buffer 15*a* with an unexpected high speed, the car 1 will be subject to a large shock for ensuring safety that the car must be stopped within the limited distance from a contact point with the buffer 15*a* to the hoistway end. The buffers 15 have respective predetermined speeds (hereinafter, "specified speed(s)) depending on their capabilities, below which speeds a shock at a collision can be absorbed to a level below a specified value. Hence, a speed at a collision of the car 1 with the buffer 15*a* (hereinafter, "collision speed") must be lower than the specified speed. While this embodiment is described taking the specified speed as a base, the present invention is not limited to this speed. Another predetermined speed lower than the specified speed may be employed as a base in order to pursue a slower stopping. Note that a specified speed for the buffer 15*b* is calculated taking into account a shock to which the car 1 is subjected when the counterweight 2 collides with the buffer 15*b*.

Figure 2:
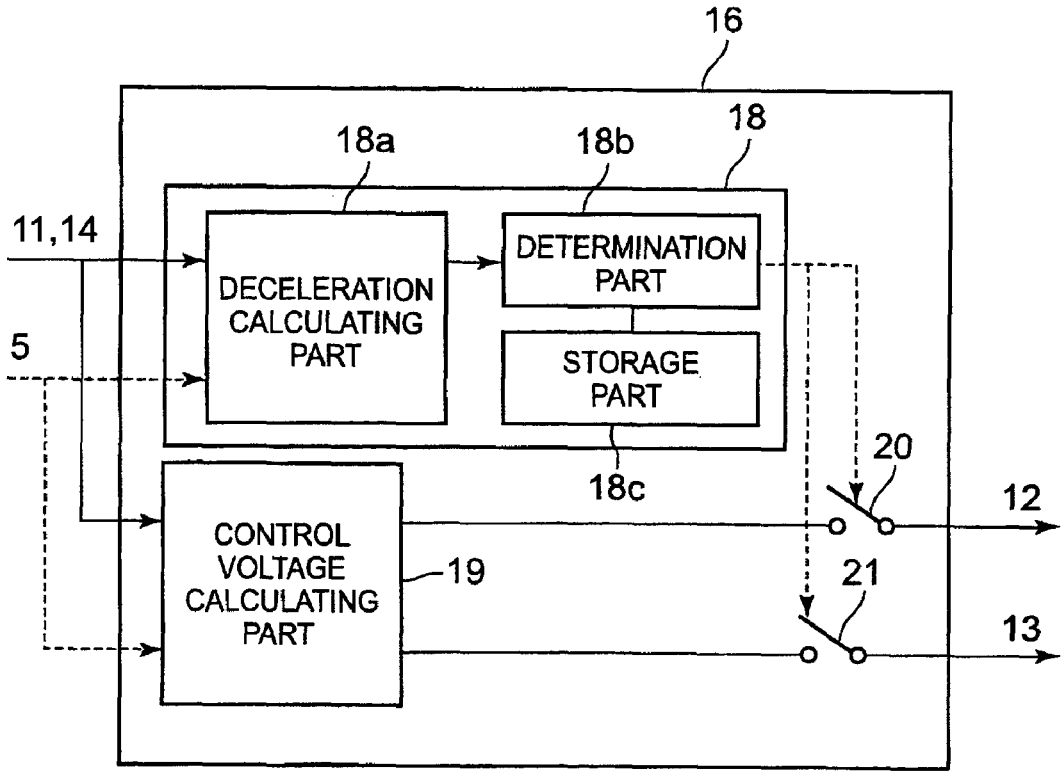
FIG. 2 is a configuration diagram of a brake control unit of Embodiment 1.

A configuration of the brake control unit 16 will be described in detail with reference to FIG. 2. The brake control unit 16 receives (i) a signal from the hoist-motor encoder 11 (or the governor 14) and (ii) a signal from the elevator control unit 5, to apply to the brake coils 12 and 13 a voltage based on these signals. The brake control unit 16 is configured with a safety state determination part 18, a control voltage calculating part 19, and safety relays 20 and 21. The safety state determination part 18 determines whether to open or close the safety relays 20 and 21 and is composed of a deceleration calculating part 18*a*, a determination part 18*b*, and a storage part 18*c* that stores a reference deceleration.

Next, operation of the elevator system in this embodiment will be briefly described. If the elevator is in an emergency mode, both signals from the hoist-motor encoder 11 (or the governor 14) and the elevator control unit 5 are transferred to the safety state determination part 18 and the control voltage calculating part 19 of the brake control unit 16. The brake control unit 16 controls the brake, based upon the information acquired by the car traveling-information acquisition means, to reduce a collision speed to below the specified speed so that a shock at a collision of the car 1 with the buffer 15*a* can be absorbed to a level below the specified value.

To be specific, the deceleration calculating part 18*a* firstly calculates a deceleration of the car 1, based upon both the signals. Then, in a case of the safety relays 20 and 21 being open, the determination part 18*b* compares the deceleration calculated by the deceleration calculating part 18*a* with the reference deceleration stored in the storage part 18*c*. If the deceleration of the car 1 is larger than the reference deceleration, the safety relays 20 and 21 are closed to put the brake into a state ready to weaken the braking force exerted on the brake pulley 7 by the brake linings 8 and 9.

In a case of the safety relays 20 and 21 being closed, if a deceleration of the car 1 is smaller than the reference deceleration by comparing, in the determination part 18*b*, the deceleration of the car 1 with the reference deceleration, the safety relays are opened to put the brake into a state unable to weaken the braking force exerted on the brake pulley 7 by the brake linings 8 and 9.

The control voltage calculating part 19 calculates and outputs, based upon (i) the signal from the hoist-motor encoder 11 (or the governor 14) and (ii) the signal from the elevator control unit 5, a voltage to be applied to the brake coils 12 and 13, in order to decelerate the car 1 with the target deceleration. While described in this embodiment is the case where the voltage is calculated and outputted with respect to the target deceleration by the control voltage calculating part 19, the present invention is not limited to this case. The voltage may be calculated with respect to the reference deceleration or a speed variation ideal for the car 1 when decelerating.

The reference deceleration and the target deceleration are explained here. The reference deceleration is defined to be always larger than a deceleration necessary for reducing a collision speed to below the specified speed, even under a worst condition for the car 1 to decelerate (a condition where the car 1 is descending with a maximum load or ascending with a minimum load) in an emergency stop mode. The target deceleration is defined to be larger than the reference deceleration (see FIG. 3B). It is noted that the reference deceleration is defined to be larger than a deceleration calculated according to Eqn. (1) taking into account an accelerating force and an inertia that are assumed under a most difficult condition for decelerating.

Figure 3:
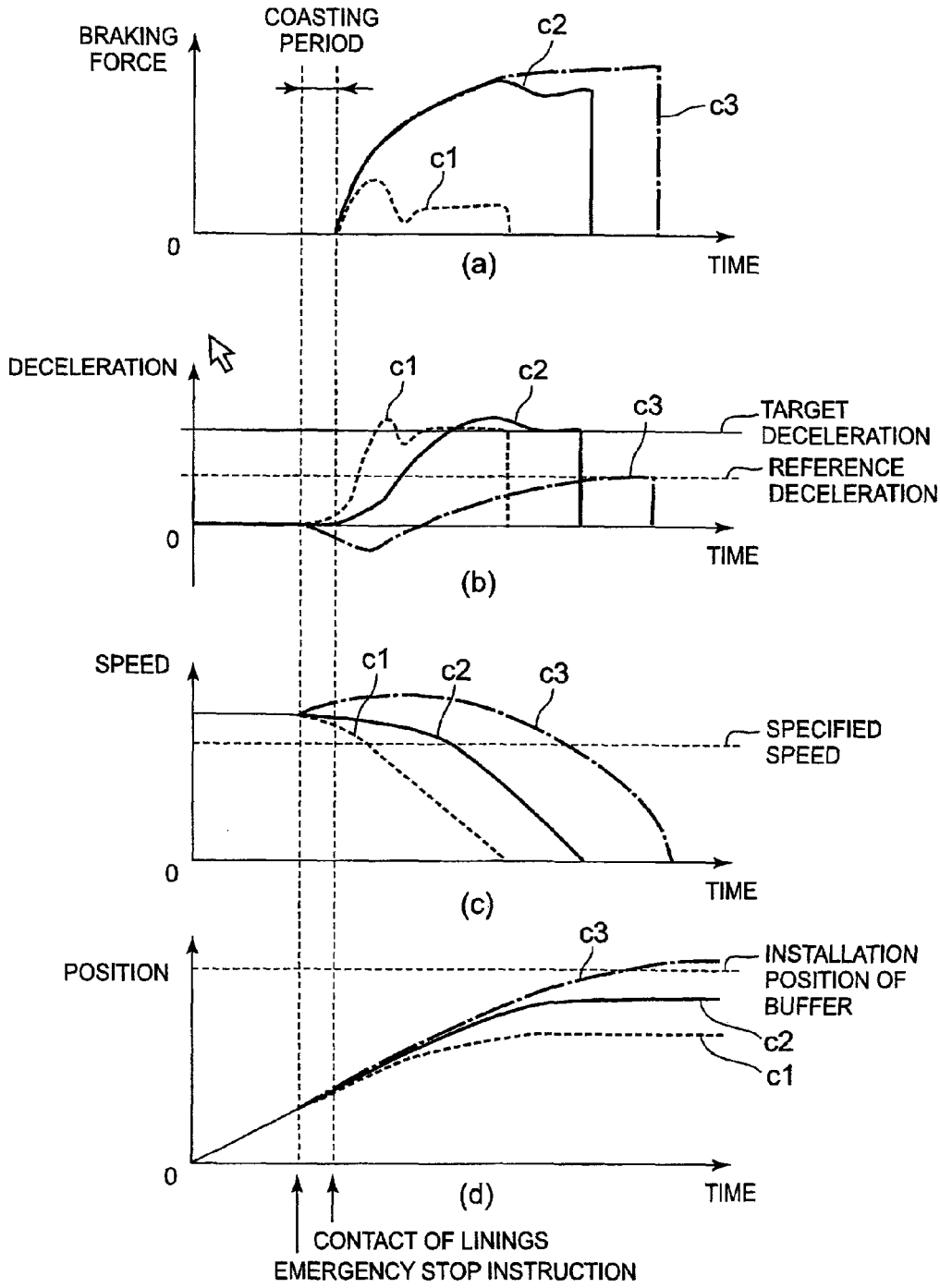
FIG. 3 shows graphs of (a) time variations of braking force, (b) time variations of car deceleration, (c) time variations of car speeds, and (d) time variations of car positions, in Embodiment 1.

Three typical decelerating cases c1, c2, and c3 are explained with reference to FIG. 3. The graphs in FIG. 3 show time variations of state quantities of the car 1 in this embodiment when the car is controlled to keep up with the target deceleration by adjusting braking force of the brake: FIGS. 3A to 3D show time variations of the braking force, time variations of car deceleration, time variations of car speeds, and time variations of car positions, respectively. The case c1 shows a situation where the car 1 is descending with a minimum load or ascending with a maximum load; the case c3 shows a situation where the car 1 is descending with a maximum load or ascending with a minimum load; and the case c2 shows a situation between the case c1 and the case c3. In emergency stopping of the car 1, the case c1 is easy to brake and the case c3 is difficult to brake.

In each graph of FIGS. 3A to 3D, during a period from a time when the elevator is put into an emergency stop mode under an emergency stop instruction to a time when the brake linings 8 and 9 come into contact with the brake pulley 7 (contact of the linings), no braking force is exerted by the brake, so that the car 1 is coasting, and is decelerating in the case c1 or accelerating in the case c3 during the coasting by a force due to the weight difference between the car and the counterweight (see FIGS. 3B and 3C).

After that, in the case c1, a large braking force is temporarily exerted by the brake, whereby the deceleration exceeds the target deceleration. For this reason, the braking force of the brake is weakened. As a result, since the collision speed does not exceed the specified speed, no excessive decelerating is needed, thereby allowing the car 1 to be slowly stopped without being subjected to an excessive deceleration shock.

In the case c2, a large braking force is temporarily exerted by the brake, and then, if the deceleration exceeds the target deceleration, the braking force is weakened by adjusting down the brake. If the deceleration falls again below the target deceleration by the weakening of the braking force, a large braking force acts again by the brake. Thus, by controlling the deceleration to keep up with the target deceleration larger than the reference deceleration, the collision speed can be reduced to below the specified speed. Therefore, the car 1 can be stopped without being subjected to an excessive deceleration shock.

In the case c3, the force due to the weight difference between the car and the counterweight acts maximally in the traveling direction. For that reason, the deceleration is minimal and the collision speed becomes larger. However, since the reference deceleration is, as described above, set larger than a maximum deceleration that will be generated under such conditions, a larger braking force is exerted to approximate the deceleration to the target deceleration (in FIG. 3, approximate finally to the reference deceleration). Thus, the brake can be adjusted to reduce the collision speed to below the specified speed, and the car can thereby be stopped without being subjected to an excessive deceleration shock.

It is noted here that deceleration is expressed by the following relation:

$$\alpha = \frac{F_1 - F_2}{m}, \tag{1}$$

where m is total inertia mass of the elevator (including mass of the car 1 and mass of passengers); F1 is braking force to be exerted on the car 1 for it to reach the target deceleration, and F2 is accelerating force due to the weight difference between the car and the counterweight.

As described above, in Embodiment 1, collision speeds of the car 1 can be reduced to below the specified speed as well as slow stopping can be realized.

While the three typical cases are explained here, the behavior of the car 1 is not limited to that shown in FIG. 3. Namely, the behavior of the car 1 is varied depending upon a distance from the car 1 to the buffers 15, a speed of the car 1, and the like in an emergency stop mode.

Embodiment 2

A brake control unit 16 in this embodiment determines whether a collision speed of the car 1 can be reduced to below the specified speed, based upon a current speed of the car 1 and a current remaining distance from the car 1 to the buffers 15 (hereinafter, "remaining distance") that are acquired from the car traveling-information acquisition means such as the hoist-motor encoder 11, governor 14, or a position sensor, thereby to instruct to open or close the safety relays 20 and 21.

Figure 4:
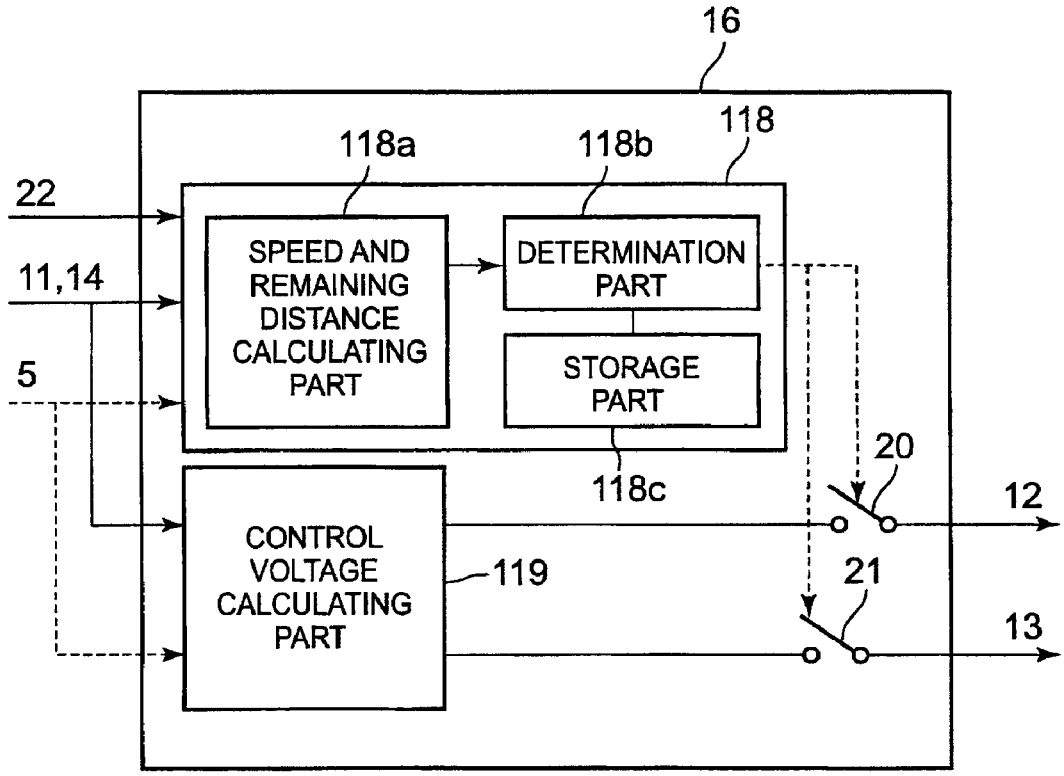
FIG. 4 is a configuration diagram of a brake control unit of Embodiment 2.

A configuration of the brake control unit 16 of this embodiment will be described with reference to FIG. 4. The brake control unit 16 receives (i) traveling state information, such as a speed of the car 1 and a remaining distance, from the car traveling-information acquisition means such as the hoist-motor encoder 11, the governor 14, or a position sensor, and (ii) an instruction to brake the brake pulley 7 to stop the car 1, from the elevator control unit 5, when the elevator comes into a state that requires a halt of its operation, and then operates, based on the information, the safety relays 20 and 21 to apply voltage to the brake coils 12 and 13.

The brake control unit 16 is configured with a safety state determination part 118, a control voltage calculating part 119, and the safety relays 20 and 21. The safety state determination part 118 determines whether to open or close the safety relays 20 and 21 and is composed of a speed and remaining distance calculating part 118*a*, a determination part 118*b*, and a storage part 118*c* that stores relations of speeds of the car 1 versus remaining distances at opening the safety relays 20 and 21 (hereinafter, "speed versus remaining distance relations" at opening the relays), which relations enable collision speeds of the car 1 to be reduced to below the specified speed.

Figure 5:
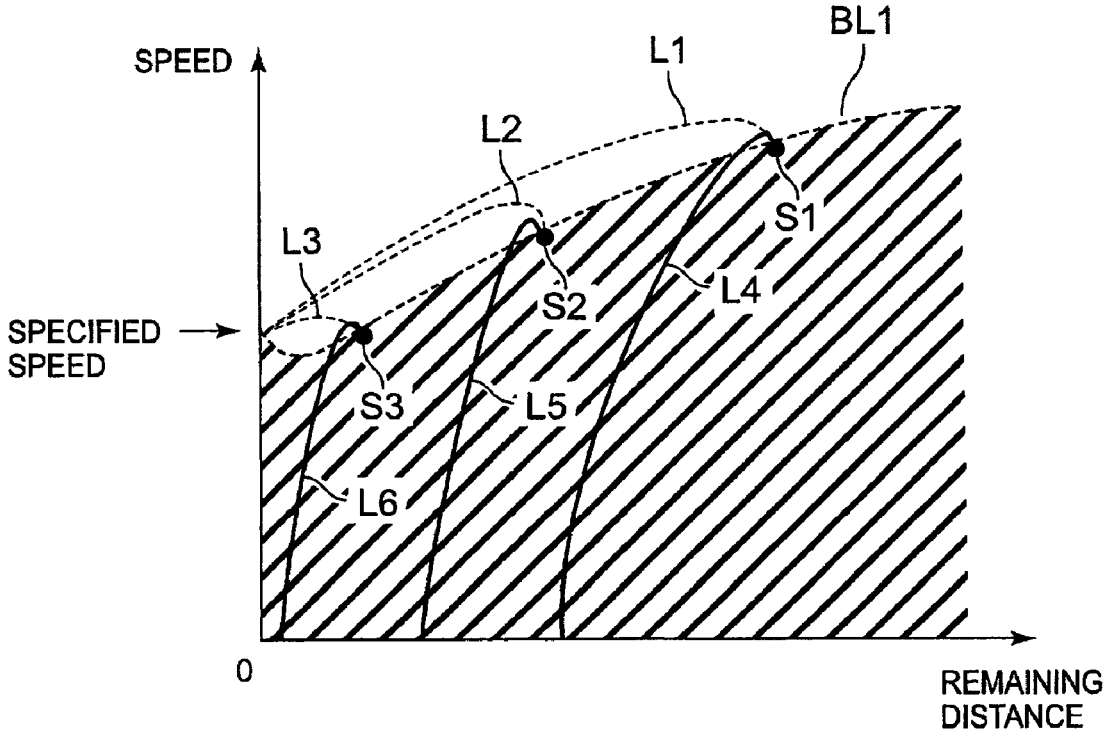
FIG. 5 is a graph showing car speed versus remaining distance relations under conditions where weakening of braking force is allowable, in Embodiment 2.

FIG. 5 illustrates the relations of speeds versus remaining distances at opening the relays, i.e., the relations between (i) the speed of the car 1 and (ii) the remaining distance for determining whether a collision speed can be reduced to below the specified speed. By controlling the braking force ready to be weakened if a state of the car 1 is within the shaded region in the graph of the figure and by controlling the braking force unable to be weakened if a state happens to be out of the shaded region, a collision speed can be reduced to below the specified speed.

The boundary line BL1 of the shaded region shows plots of maximum speeds for respective remaining distances, below which speeds collision speeds of the car 1 can be reduced to below the specified speed in cases of the car 1 being stopped in emergency. In these cases, defining a time $t_0$ as an interval until the car 1 comes into contact with the buffer, a remaining distance $x_0$ on the line for an initial speed can be calculated from the following integral equations:

$$\left.\begin{aligned} & m\alpha(t) = F(t) - F_2' \\ & v_0 - \int_0^{\tau 0} \alpha(t)\,dt = V \\ & x_0 = \int_0^{\tau 0} v_0\,dt - \int_0^{\tau 0}\left[\int \alpha(t)\,dt\right]dt \end{aligned}\right\}. \tag{2}$$

The boundary line BL1 can thereby be plotted in the graph of FIG. 5.

Each variable and constant is defined with respect to the car 1, and $\alpha(t)$ denotes acceleration of the car 1, F(t) braking force by the brake, $F_2'$ a maximum accelerating force in a case of a maximum weight difference between the car 1 and the counterweight 2, m total inertia mass of the elevator in a loaded state at the weight difference, $v_0$ a speed of the car 1 at the start of an emergency stop, and V a speed at the time of contact with the buffer.

The dotted lines L1 to L3 in the figure indicate trajectories of speeds and remaining distances when the car is forcibly decelerated from states S1, S2, and S3 on the boundary of the shaded region to stopped states, under loaded conditions where respective collision speeds become maximal. Thus, the collision speeds are ensured that they are always reduced to below the specified speed. On the other hand, the solid lines L4 to L6 in the figure indicate trajectories of speeds and remaining distances in cases of the car being forcibly decelerated from the states S1, S2, and S3 on the boundary of the shaded region to stopped state, under loaded conditions where respective collision speeds become minimal. In these cases, of course, collision speeds are reduced to below the specified speed.

Namely, an actual speed of the car 1 acquired by the car traveling-information acquisition means is compared with a speed of the car 1 for a remaining distance, which are stored in the storage means, corresponding to an acquired actual remaining distance. Moreover, in the case of monitoring speed and remaining distance, if the car 1 is determined to be in a loaded state easy to stop by being further provided with a car load-weight acquisition means that calculates a load weight of the car 1 and with a car traveling-direction detecting means that detects a traveling direction of the car 1, the conditions able to reduce collision speeds to below the specified speed can be extended by closing the safety relays 20 and 21 to put the brake into a state ready to weaken. In a case of taking easiness of stopping the car out of consideration, the speed versus remaining distance relations at opening the relays are calculated by presuming a situation of a maximum weight difference between the car 1 and the counterweight 2 to set values of the acceleration force $F_2'$ and the total inertia mass m in the integral equations (2) for calculating the boundary BL1 in FIG. 5. However, if the car is determined to be in a state easy to stop from its load weight and its traveling direction, the car at the same speed can be put into a lower speed state in a shorter distance. Accordingly, using the speed versus remaining distance relations at opening the relays calculated by setting values of the acceleration force $F_2'$ and the total inertia mass m taking into account a load weight and a traveling direction, controllable conditions realized by closing the safety relays 20 and 21 can be extended, which brings about an effect of reducing the occurrence frequency of a larger deceleration due to no controlling.

It is note here that the car load-weight acquisition means in this embodiment is provided with a weighing device 22 that measures a load weight in the car, and calculates a load weight of the car 1 from a signal of the device; and the car traveling-direction detecting means determines a traveling direction from the signal of the hoist-motor encoder 11, the governor 14, or the like.

Figure 6:
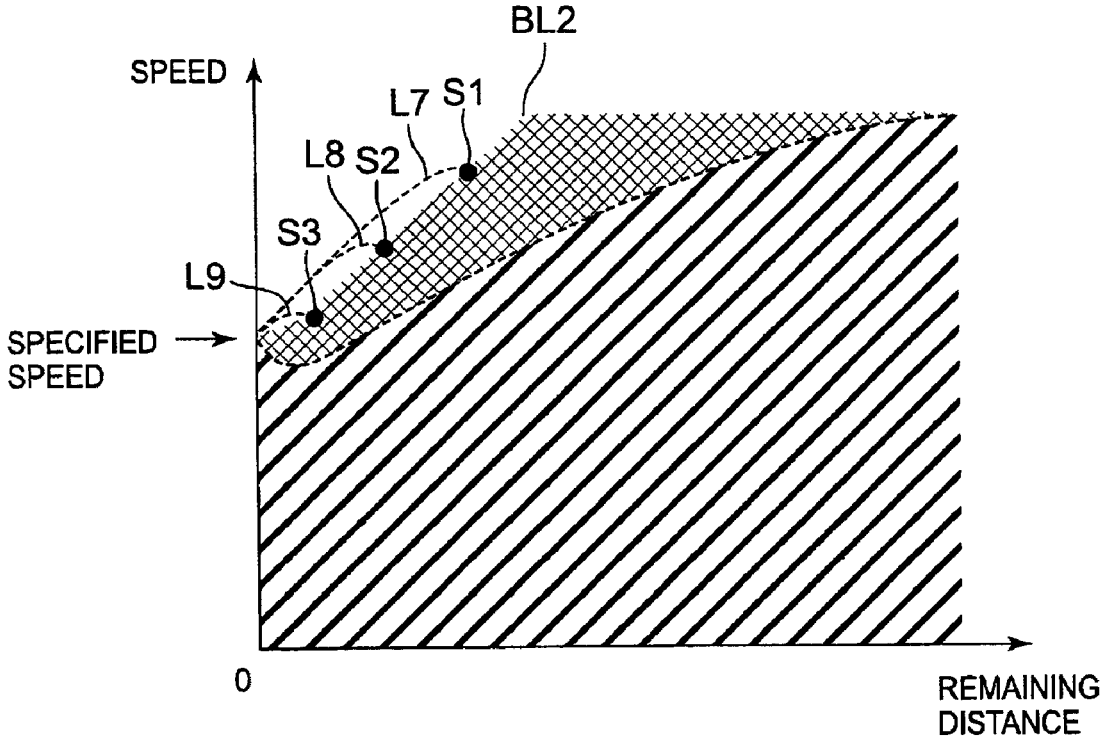
FIG. 6 is a graph showing car speed versus remaining distance relations under conditions where weakening of braking force is allowable, in Embodiment 2.

Specifically, controlling the braking force to weaken is also allowable in the extended shaded region C as illustrated in FIG. 6. The boundary BL2 is calculated by setting individual constants in the Eqns. (2) taking change of load conditions into account. In this case, the boundary BL2, i.e., the speed versus remaining distance relations at opening the relays, is varied depending on the load conditions. To realize specifically, a plurality of speed versus remaining distance relations at opening the relays is stored in the storage part 118*c*, and the determination part 118*b* utilizes the relations in determining open/close of the safety relays by retrieving, as appropriate according to a load weight, a speed versus remaining distance relation at opening the relays. Alternatively, parameters for calculating the speed versus remaining distance relations at opening the relays are stored in the storage part 118*c*, and the speed and remaining distance calculating part 118*a* may calculate, as appropriate according to a load weight, a speed versus remaining distance relation at opening the relays using these parameters and utilize it in the determination.

Next, operation of the elevator system in this embodiment is briefly described. In a case of the elevator being in an emergency stop mode, both signals from the hoist-motor encoder 11 (or the governor 14) and the elevator control unit 5 are transferred to the safety state determination part 118 and the control voltage calculating part 119. The control voltage calculating part 119 calculates based on both signals a voltage to be applied to the brake coils 12 and 13 and outputs it.

In the safety state determination part 118, the speed and remaining distance calculating part 118*a* calculates a current speed of the car 1 and a current remaining distance, based on traveling state information of the car 1 obtained from the car traveling-information acquisition means such as the hoist-motor encoder 11, the governor 14, or the position sensor. Then, the determination part 118*b* compares data in the storage part 118*c* (the speed of the car 1 versus remaining distance relations shown in FIG. 5 stored in the storage part 118*c*) with outputs of the speed and remaining distance calculating part 118*a* (a car speed and a remaining distance calculated based on information acquired by the car traveling-information acquisition means). Namely, if a condition of the car 1 is within the shaded region shown in FIG. 5, an instruction to close the safety relays 20 and 21 is output to put the brake into a state ready to weaken the braking force exerted on the brake pulley 7 by the brake linings 8 and 9. On the other hand, if a condition of the car 1 is without the shaded region shown in FIG. 5, an instruction to open the safety relays 20 and 21 is output so as not to weaken the braking force exerted on the brake pulley 7 by the brake linings 8 and 9.

As described above, in this embodiment, since determination whether or not to open the safety relays 20 and 21 is made by monitoring (i) a current speed of the car 1 and (ii) a current remaining distance, an effect is brought about that extends controllable conditions as wide as possible.

Namely, in the case of ensuring the reduction to the specified speed within a predetermined distance while keeping a predetermined deceleration as with Embodiment 1, even though there is a sufficient distance to the buffer for keeping the predetermined deceleration, the car may in some cases come into a state not allowed to weaken the braking force and the decelerating may thereby exhibit a small effect in shock reduction. On the other hand, in this embodiment, stopping of the car can be accomplished with a deceleration lower than that in a case with Embodiment 1 by controlling the braking force according to determinations response to the state varying from time to time, even if the car comes into a state not allowed to weaken the braking force when the remaining distance is determined to be shorter than a distance necessary for reducing the speed to below the specified speed. Therefore, slow stopping of the car 1 can be realized.

The technologies have been described in Embodiments 1 and 2 that realize slow stopping of the car 1, when coming into contact with the buffers 15, by controlling the braking force. A position, a speed, a deceleration, and a traveling direction of the car 1 may be converted from a signal from the hoist-motor encoder 11 or the governor 14, or may be acquired from an acceleration sensor or a position sensor (both not shown) provided with the car 1. Moreover, the car load-weight acquisition means may utilize a method of calculating a traveling load from a hoist-motor coil current during traveling. Furthermore, while the safety state determination part 18 or 118 is configured to send the instruction to the safety relays 20 and 21, the safety state determination parts 18 or 118 may send a stop instruction to the control voltage calculating part 19 or 119. Furthermore, while the safety state determination part 18 or 118 is provided in the brake control unit 16, a controllable state determination part (not shown) may be separately provided in place of the safety state determination part 18 or 118.

Industrial Applicability

The present invention can be applied to a brake system for braking an elevator car in emergency.

What is claimed is:

1. An elevator system comprising:

a car supported for traveling up and down along a hoistway;

a buffer positioned for stopping the car at an end of the hoistway;

a brake configured for braking travel of the car;

a car traveling-information acquisition means for acquiring car traveling information; and a brake controller for continuously controlling the brake to selectively put the brake into a state ready to weaken the braking force or to put the brake into a state unable to weaken the braking force, to reduce a collision speed at a collision of the car with the buffer to below a predetermined speed, based upon the information acquired by the car traveling-information acquisition means, so that a shock at the collision of the car with the buffer can be absorbed to a level below a specified value.

2. The elevator system of claim 1, wherein the car traveling-information acquisition means acquires information on a deceleration of the car, and the brake controller controls the brake by comparing the deceleration of the car with a deceleration for reducing the collision speed to below the predetermined speed.

3. The elevator system of claim 1, wherein the car traveling-information acquisition means acquires information on a speed of the car and a distance from the car to the buffer; and the brake controller includes a storage part for storing a speed of the car versus distance from the car to the buffer relation that enables the collision speed to be reduced to below the predetermined speed by braking of the brake, and continuously controls the brake to selectively put the brake into a state ready to weaken the braking force or to put the brake into a state unable to weaken the braking force, to reduce the collision speed at the collision of the car with the buffer to below the predetermined speed, by comparing the speed of the car versus distance from the car to the buffer relation stored in the storage part with the information on the speed of the car and the distance from the car to the buffer acquired by the car traveling-information acquisition means.

4. The elevator system of claim 3, further comprising:

a car load-weight acquisition means for calculating a load weight of the car; and a car traveling-direction detecting means for detecting a traveling direction of the car, wherein the storage part stores a speed of the car versus distance from the car to the buffer relation calculated by taking into account the load weight and the traveling direction of the car, for the collision speed to be reduced to below the predetermined speed; and the brake controller continuously controls the brake to selectively put the brake into a state ready to weaken the braking force or to put the brake into a state unable to weaken the braking force, to reduce the collision speed at the collision of the car with the buffer to below the predetermined speed, by comparing the speed of the car versus distance from the car to the buffer relation stored in the storage part with information acquired by the car load-weight acquisition means, the car traveling-direction detecting means, and the car traveling-information acquisition means.

5. An elevator system comprising:

a counterweight supported for traveling up and down along a hoistway;

a buffer positioned for stopping the counterweight at an end of the hoistway;

a brake configured for braking travel of the counterweight;

a counterweight traveling-information acquisition means for acquiring counterweight traveling information; and a brake controller for continuously controlling the brake to selectively put the brake into a state ready to weaken the braking force or to put the brake into a state unable to weaken the braking force, to reduce a collision speed at a collision of the counterweight with the buffer to below a predetermined speed, based upon the information acquired by the counterweight traveling-information acquisition means, so that a shock at the collision of the counterweight with the buffer can be absorbed to a level below a specified value.

* * * * *